US009976505B2

(12) United States Patent
Zhang

(10) Patent No.: US 9,976,505 B2
(45) Date of Patent: May 22, 2018

(54) METHOD FOR OPERATING AN INJECTOR OF AN INJECTION SYSTEM OF AN INTERNAL COMBUSTION ENGINE

(71) Applicant: Continental Automotive GmbH, Hannover (DE)

(72) Inventor: Hong Zhang, Tegernheim (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 63 days.

(21) Appl. No.: 15/100,397

(22) PCT Filed: Nov. 18, 2014

(86) PCT No.: PCT/EP2014/074852
§ 371 (c)(1),
(2) Date: May 31, 2016

(87) PCT Pub. No.: WO2015/078723
PCT Pub. Date: Jun. 4, 2015

(65) Prior Publication Data

US 2016/0298564 A1 Oct. 13, 2016

(30) Foreign Application Priority Data

Nov. 28, 2013 (DE) ..... 10 2013 224 385

(51) Int. Cl.
*F02M 51/06* (2006.01)
*F02D 41/20* (2006.01)

(52) U.S. Cl.
CPC ..... *F02D 41/2096* (2013.01); *F02D 41/20* (2013.01); *F02M 51/0603* (2013.01);
(Continued)

(58) Field of Classification Search
CPC ..... F02D 41/2096; F02D 2041/2034; F02D 2041/2037; F02D 2041/2055; F02M 51/0603; F02M 51/0607
(Continued)

(56) References Cited

U.S. PATENT DOCUMENTS 6,298,829 B1 * 10/2001 Welch ..... F02D 41/20 123/467
6,575,138 B2 6/2003 Welch et al. ..... 123/467
(Continued)

FOREIGN PATENT DOCUMENTS

DE 19921456 A1 11/2000 ..... F02D 41/20
DE 102004062073 A1 7/2006 ..... F02D 41/20
(Continued)

OTHER PUBLICATIONS

German Office Action, Application No. 102013224385.5, 5 pages, dated Jul. 8, 2014.
(Continued)

*Primary Examiner* — Erick Solis
(74) *Attorney, Agent, or Firm* — Slayden Grubert Beard PLLC

(57) ABSTRACT

The present disclosure teaches a method for operating an injector with piezoelectric direct drive of an injection system of an internal combustion engine. The method may comprise providing a current to the piezoelectric actuator at a first level, then quickly reducing the current for charging the piezoelectric actuator before or after the opening of the nozzle needle and before the mechanical impacting of the needle or the hydraulic equilibrium point of the needle, the current reduced to such an extent that the sum of the forces acting on the nozzle needle become approximately zero in the case of a small needle lift (part lift), and after reducing the current, supplying a low current in a constant or ramp-
(Continued)

shaped fashion until a predetermined setpoint energy is reached.

11 Claims, 2 Drawing Sheets

(52) U.S. Cl.
CPC . *F02M 51/0607* (2013.01); *F02D 2041/2037* (2013.01); *F02D 2041/2048* (2013.01); *F02D 2041/2055* (2013.01)

(58) Field of Classification Search
USPC ..... 123/478
See application file for complete search history.

(56) References Cited

U.S. PATENT DOCUMENTS

| | | | | |
|---|---|---|---|---|
| 8,239,115 | B2 | 8/2012 | Ascher et al. | 701/103 |
| 8,543,314 | B2 | 9/2013 | Nakata et al. | 701/103 |
| 8,578,896 | B2 | 11/2013 | Chassagnoux et al. | 123/90.11 |
| 2001/0032612 | A1* | 10/2001 | Welch | F02D 41/20 123/294 |
| 2007/0290573 | A1* | 12/2007 | Sykes | F02D 41/2096 310/311 |
| 2010/0063709 | A1* | 3/2010 | Ascher | F02D 41/2096 701/103 |
| 2011/0042594 | A1* | 2/2011 | Chassagnoux | F01L 9/04 251/129.01 |
| 2015/0096539 | A1* | 4/2015 | Leblon | F02D 41/2096 123/478 |
| 2016/0281624 | A1* | 9/2016 | Dames | F02D 41/40 |

FOREIGN PATENT DOCUMENTS

| | | | | |
|---|---|---|---|---|
| DE | 60207239 | T2 | 8/2006 | F02D 41/20 |
| DE | 102008041659 | A1 | 3/2009 | F02D 41/38 |
| DE | 102008040412 | A1 | 9/2009 | F02D 41/20 |
| EP | 1860307 | A1 | 11/2007 | F02D 41/20 |
| WO | 2003/083278 | A1 | 10/2003 | F02D 41/20 |
| WO | 2015/078723 | A1 | 6/2015 | F02D 41/20 |

OTHER PUBLICATIONS

International Search Report and Written Opinion, Application No. PCT/EP2014/074852, 21 pages, dated Feb. 10, 2015.

* cited by examiner

METHOD FOR OPERATING AN INJECTOR OF AN INJECTION SYSTEM OF AN INTERNAL COMBUSTION ENGINE

CROSS-REFERENCE TO RELATED APPLICATIONS

This application is a U.S. National Stage Application of International Application No. PCT/EP2014/074852 filed Nov. 18, 2014, which designates the United States of America, and claims priority to DE Application No. 10 2013 224 385.5 filed Nov. 28, 2013, the contents of which are hereby incorporated by reference in their entirety.

TECHNICAL FIELD

The present disclosure relates generally to an injector of an injection system of an internal combustion engine, and specifically to an injector with piezoelectric direct drive for opening the nozzle needle of the injector.

BACKGROUND

The term "piezoelectric direct drive" used here is intended to comprise in this context driving without a servo valve, or purely mechanical driving, for example by means of a lever system, or driving with a hydraulic transmission means.

In such a drive, the nozzle needle of the injector is accelerated strongly after the opening, with the result that when there is a mechanical impact of the nozzle needle (in the case of a mechanical drive system) or when there is a hydraulic equilibrium point (in the case of a hydraulic equilibrium system), the nozzle needle oscillates a few times and brings about a characteristic curve ripple. As a result, the quantity accuracy in this range is reduced.

In order to eliminate this problem, in the case of mechanical drive systems it has been attempted to detect the corresponding impact point and to avoid this range for implementation of the injection time.

SUMMARY

The present invention is based on the object of making available a method of the type described at the beginning with which the abovementioned characteristic curve ripple of the nozzle needle can be prevented, or at least reduced, in a particularly accurate way.

The present disclosure teaches a method for operating an injector with piezoelectric direct drive of an injection system of an internal combustion engine, wherein the piezoelectric actuator of the injector is driven to charge the latter with a current profile for opening the nozzle needle of the injector. In some embodiments, the method may include before or after the opening of the nozzle needle and before the mechanical impacting of the needle or the hydraulic equilibrium point of the needle the current for charging the piezoelectric actuator is firstly quickly reduced to such an extent that the sum of the forces acting on the nozzle needle become approximately zero in the case of a small needle lift (part lift), and in that after the charging is controlled with a low current in a constant or ramp-shaped fashion until the setpoint energy is reached.

In some embodiments, the piezoelectric actuator is firstly charged with a high current I_high and then quickly reduced.

In some embodiments, after a delay with respect to the time of the opening of the needle, the current is set to a low value I_low until the needle has reached a specific needle lift (part lift) at which the sum of the forces acting on the needle at this point corresponds to approximately zero.

In some embodiments, after the specific needle lift (part lift) has been reached, the current is set in such a way that the needle lift rises in a ramp-shaped fashion with a defined gradient up to the end position.

In some embodiments, operation is carried out with a positive or negative reference time with respect to the time of the opening of the needle.

In some embodiments, in the case of a negative value of the delay, the current is already reduced before the opening of the needle.

In some embodiments, the current is kept constant around the needle opening time.

In some embodiments, the needle opening time is detected on the basis of the piezoelectric voltage signal.

In some embodiments, the detected needle opening time is used to regulate I_high, in order to implement the same needle opening time setpoint value as a function of the rail pressure.

In some embodiments, the current I_low and I_ramp is set as a function of the corrected I_high.

In some embodiments, in the event of a mechanical impacting of the needle or a needle oscillation about the hydraulic equilibrium point being still present after the execution of the method, the severity of the impact or of the oscillation is detected by means of the piezoelectric voltage, and the current I_ramp and the final energy are reduced until the needle overshoot at the impact or at the equilibrium point is virtually undetectable.

BRIEF DESCRIPTION OF THE DRAWINGS

The invention is explained in detail below on the basis of exemplary embodiments and in conjunction with the drawing, in which.

DETAILED DESCRIPTION

Figure 1:
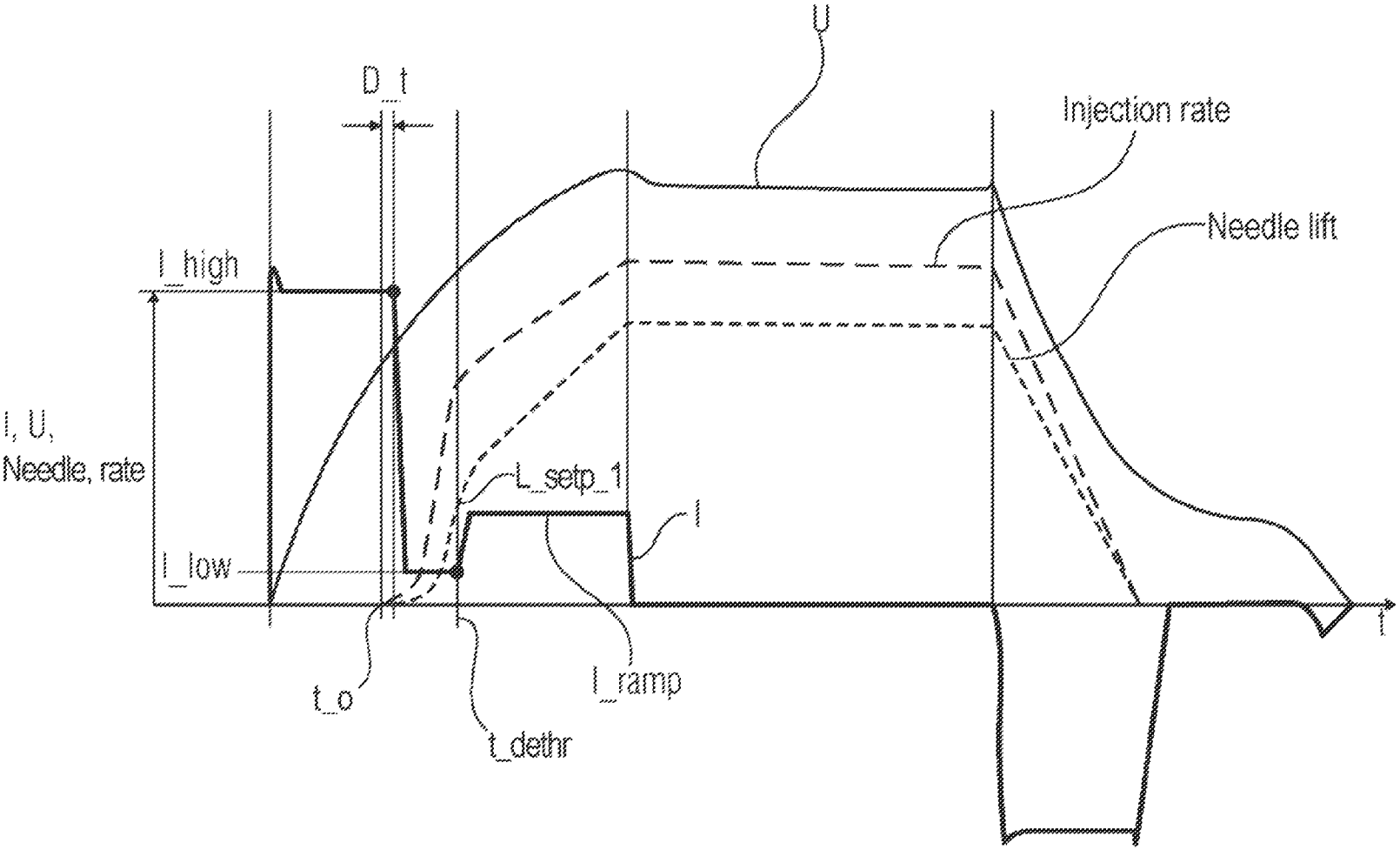
FIG. 1 shows a diagram in which the profile of the charging current I, of the piezoelectric voltage U, of the needle lift and of the injection rate are illustrated plotted against the time in a first embodiment of the teachings of the present disclosure.

In some embodiments, before or after the opening of the nozzle needle and before the mechanical impacting of the needle or the hydraulic equilibrium point of the needle the current for charging the piezoelectric actuator is firstly quickly reduced to such an extent that the sum of the forces acting on the nozzle needle become approximately zero in the case of a small needle lift (part lift). Afterward, the charging is controlled with a low current in a constant or ramp-shaped fashion until the setpoint energy is reached.

The forces acting on the nozzle needle may be the forces of the piezoelectric actuator, the forces of a spring of the nozzle needle, and hydraulic forces. Therefore, at this point no further acceleration takes place and a constant speed is present.

The injection system, mentioned here, of an internal combustion engine has a high-pressure accumulator (rail) from which the injector is supplied with fuel at a high pressure.

The methods taught herein may include modifying the current profile for the charging of the piezoelectric actuator in such a way that the abovementioned characteristic curve ripple is prevented. The methods ensure that the nozzle needle is opened very quickly at the start, in order to achieve rapid dethrottling. In the case of a relatively high needle lift, for example starting from 50 micrometers, the needle speed becomes lower and is reduced to a minimum before the impact point or equilibrium point, which reduces or eliminates the corresponding needle overshoot at the impact point/equilibrium point. The disadvantageous characteristic curve ripple or S shape is therefore largely eliminated and/or reduced.

In some example methods, the piezoelectric actuator is firstly charged with a current of I_high and then quickly reduced. After a delay with respect to the time of the opening of the needle, the current is set to a low value I_low until the needle has reached a specific needle lift (part lift), at which the sum of the forces acting on the needle at this point corresponds to approximately zero. This specific needle lift (part lift) is, for example, approximately 50 micrometers. The value for this lift is selected in such a way that, on the one hand, the needle seat is dethrottled to a large extent, and on the other hand the needle lift still has sufficient distance, up to the end position, for controlling the needle lift with current.

The current is then set again to a different value. After the specific needle lift (part lift) has been reached, the current is preferably set in this context in such a way that the needle lift rises in a ramp-shaped fashion with a defined gradient up to the end position, without in this context causing a characteristic curve ripple at the impact point/equilibrium point (the kinetic energy of the needle is reduced to a large extent here). The control of the needle lift after the dethrottling of the seat up to the end position with a slow ramp also brings about a slow increase in the injection rate, which also benefits the combustion.

Instead of ramp-shaped control, the current can in this context also be controlled in such a way that it remains constant until the setpoint energy is reached.

Both the setpoint value for the needle opening time and the prescribed current value I_high is preferably implemented as a function of the rail pressure.

In some embodiments, operation can be carried out with a positive or negative delay with respect to the time of the opening of the needle. In the case of a negative value of the delay, the current is already reduced (from I_high to I_low) before the opening of the needle.

The current may be kept constant around the needle opening time. In this way, the needle opening time can be determined accurately.

In some embodiments, the needle opening time is (additionally) detected on the basis of the piezoelectric voltage signal. When the needle opens, the piezoelectric actuator is relieved by the dethrottling of the seat and brings about a small voltage dip which is superimposed on the rising voltage caused by the current. In this way, the needle opening time can be determined.

The detected needle opening time may be used to regulate I_high, in order to implement the same needle opening time setpoint value as a function of the rail pressure, and as a result increase the quantity accuracy. In other words, if the opening time occurs later than the setpoint value, the current I_high is correspondingly increased, in order to adjust the opening time back to the setpoint value. If the opening time occurs early, I_high is reduced. The current I_low and I_ramp can also be set as a function of the corrected current I_high. The setpoint charging energy for reaching a first setpoint value of the needle lift L_setp_1 is preferably calculated as a function of the rail pressure. On this basis, the charging current I_high is set in such a way that the setpoint charging energy is already implemented, and the current has been reduced to I_low=0, before the opening of the needle. The current I_low remains at 0 until the estimated needle lift has reached the setpoint value L_setp_1 of, for example, 50 micrometers at the time t_dethr (see FIG. 2). Then, the current is set to I_ramp until the setpoint charging energy for the implementation of the final needle lift is reached.

This charging strategy is simple and robust. At the same time, the accuracy of the determination of the opening of the needle by means of voltage is increased, since the charging-current-dependent change in the voltage occurs around the needle opening time.

Some embodiments may include, in the event of a mechanical impacting of the needle or a needle oscillation about the hydraulic equilibrium point being still present after the execution of the method, the severity of the impact or of the oscillation is detected by means of the piezoelectric voltage, and the current I_ramp and the final energy are reduced until the needle overshoot at the impact or at the equilibrium point is virtually undetectable.

In some embodiments, methods for operating an injector with piezoelectric direct drive of an injection system, having a high-pressure accumulator (rail), of an internal combustion engine, wherein the piezoelectric actuator of the injector is driven to charge the latter with a current profile for opening the nozzle needle of the injector. The current profile which is used to drive the piezoelectric actuator is modified in this context in such a way that a nozzle needle overshoot at the impact point/equilibrium point, which gives rise to a characteristic curve ripple, is reduced. The terms impact point/equilibrium point are to be understood here as meaning the impact point of the nozzle needle in the case of a mechanical drive system or the equilibrium point of the needle in the case of a hydraulic drive system. Specifically, with the modified current profile the piezoelectric actuator is firstly charged with a high current I_high. After a delay D_t with respect to the time of the opening of the needle t_o, the current is set to a low value I_low until the needle has reached approximately a part lift of 50 micrometers at t_dethr, and the total force acting on the needle corresponds approximately to zero at this point (no further acceleration, constant speed). Then, the current is set again to a different value I_ramp. I_ramp is selected in such a way that the needle lift rises in a ramp-shaped fashion with a defined gradient up to the end position, without bringing about a characteristic curve ripple at the impact point/equilibrium point.

In the embodiment of the method shown in FIG. 1, the delay D_t with respect to the needle opening time is positive. The reduction of the current from I_high to I_low therefore takes place after the opening of the needle t_o.

Figure 2:
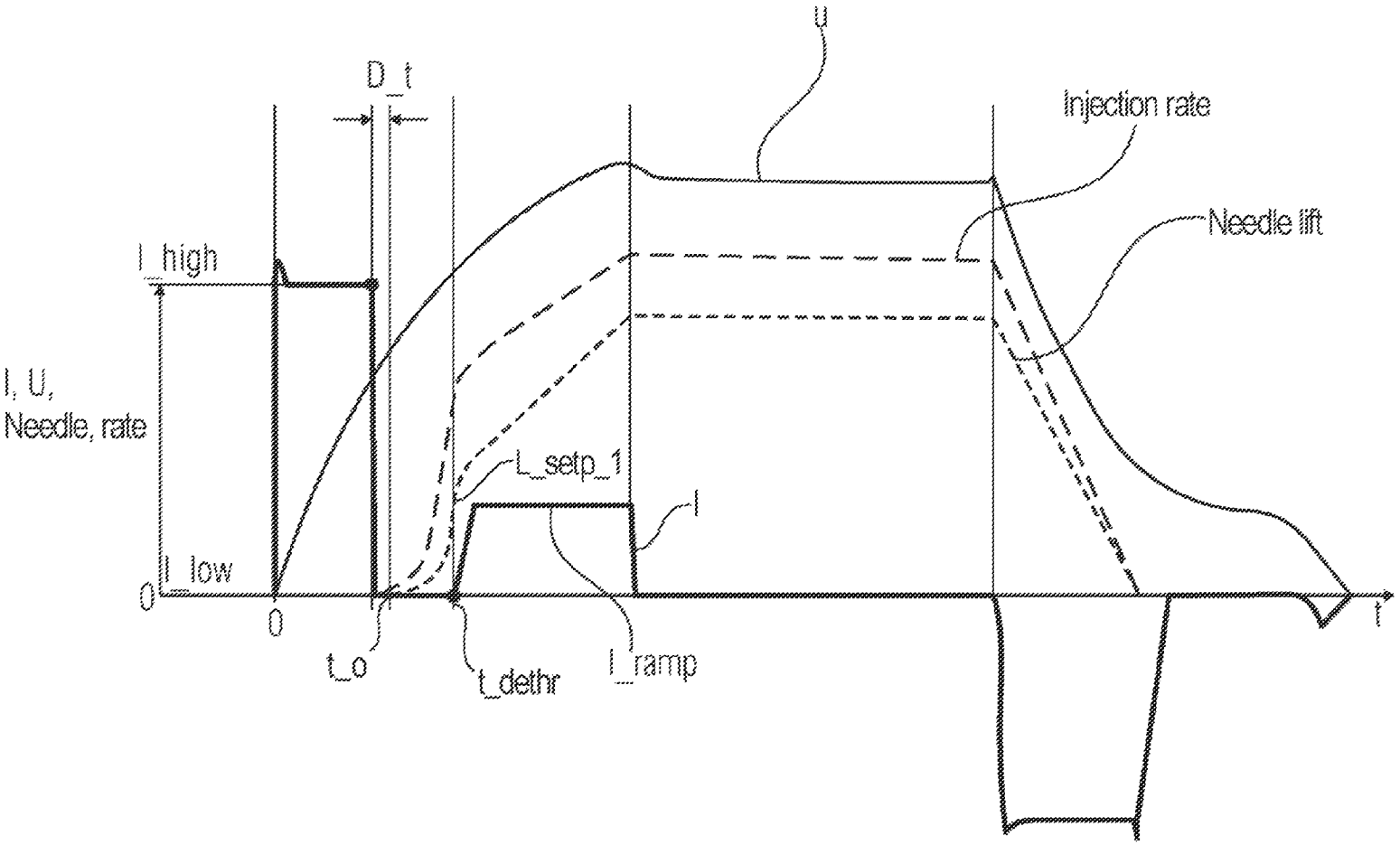
FIG. 2 shows a corresponding illustration to FIG. 1, with a second embodiment of the teachings herein.

In the embodiment illustrated in FIG. 2, the delay D_t with respect to the needle opening time is negative. In this context, the current is already reduced from I_high to I_low before the opening of the needle t_o. Furthermore, the needle current is reduced from I_high to I_low to a value of zero.

What is claimed is:

1. A method for operating an injector having a needle with piezoelectric direct drive of an injection system of an internal combustion engine, the method comprising:

providing a current at a first level to the piezoelectric actuator for a first duration while the needle is closed, quickly reducing the current for charging the piezoelectric actuator to a second level for a second duration before the mechanical impact of the needle against a mechanical stop or the hydraulic equilibrium point of the needle, the second level providing a sum of forces acting on the nozzle needle equal to approximately zero in the case of a small needle lift, and after reducing the current to the second level, supplying a current at a third level between the first level and the second level for a third duration in a constant or ramping fashion until a predetermined setpoint energy is reached.

2. The method as claimed in claim 1, wherein after a delay with respect to the time of the opening of the needle, the current is set to the second level until the needle has reached a specific needle lift at which the sum of the forces acting on the needle equals approximately zero.

3. The method as claimed in claim 2, further comprising after the specific needle lift has been reached, setting the current in such a way that the needle lift rises in a ramp-shaped fashion with a defined gradient up to the end position.

4. The method as claimed in claim 2, wherein operation is carried out with a positive or negative reference time with respect to the time of the opening of the needle.

5. The method as claimed in claim 4, wherein in the case of a negative value of the delay, the current is already reduced to the second level before the opening of the needle.

6. The method as claimed in claim 1, wherein the current is kept constant at the second level around the needle opening time.

7. The method as claimed in claim 1, wherein the needle opening time is detected on the basis of the piezoelectric voltage signal.

8. The method as claimed in claim 7, wherein the detected needle opening time is used to regulate a value of the first level, in order to implement the same needle opening time setpoint value as a function of the rail pressure.

9. The method as claimed in claim 8, wherein the second value of the current and the third value of the current are both set as a function of the corrected value of the first level.

10. The method as claimed in claim 1, wherein in the event of a mechanical impacting of the needle or a needle oscillation about the hydraulic equilibrium point being still present after the execution of the method, the severity of the impact or of the oscillation is detected by means of the piezoelectric voltage, and the current I_ramp and the final energy are reduced in following cycles until the needle overshoot at the impact or at the equilibrium point is virtually undetectable.

11. A fuel injection system for an internal combustion engine, the fuel injection system comprising:

a fuel combustion chamber;

a fuel injector having a piezoelectric actuator and a nozzle needle;

a current source driving the piezoelectric actuator; and a controller managing the profile of a current from the current source to:

provide a current at a first level for a first duration to the piezoelectric actuator while the nozzle needle is closed, quickly reduce the current to a second level for a second duration before the mechanical impact of the nozzle needle against a mechanical stop or the hydraulic equilibrium point of the needle, the second level providing a sum of forces acting on the nozzle needle equal approximately zero in the case of a small needle lift, and after reducing the current to the second level, supply a current at a third level between the first level and the second level for a third duration in a constant or ramp-shaped fashion until a predetermined setpoint energy is reached.

* * * * *